US005099669A

United States Patent [19]

Del Fabro

[11] Patent Number: 5,099,669

[45] Date of Patent: Mar. 31, 1992

[54] BENDING ASSEMBLY WITH SATELLITE

[75] Inventor: Giorgio Del Fabro, Cassacco-Fraz.Montegnacco, Italy

[73] Assignee: M.E.P. Macchine Elettronichi Piegatrici S.p.A., Reana Del Rojale, Italy

[21] Appl. No.: 630,250

[22] Filed: Dec. 19, 1990

[30] Foreign Application Priority Data

Dec. 29, 1989 [IT] Italy ..... 83545 A/89

[51] Int. Cl.[5] ..... B21D 7/024

[52] U.S. Cl. ..... 72/307; 72/217

[58] Field of Search ..... 72/307, 306, 217-219, 72/388, 387

[56] References Cited

U.S. PATENT DOCUMENTS 2,453,868 11/1948 Shaw .
3,052,277 9/1962 Stegmann ..... 72/307
3,906,784 9/1975 Coulstring ..... 72/219

FOREIGN PATENT DOCUMENTS 2305869 8/1974 Fed. Rep. of Germany ..... 72/388
3811891 6/1989 Fed. Rep. of Germany ..... 72/307
317206 12/1956 Switzerland ..... 72/217

*Primary Examiner*—Daniel C. Crane
*Attorney, Agent, or Firm*—Antonelli, Terry, Stout & Kraus

[57] ABSTRACT

Bending assembly with satellite to bend at least one end of solid or hollow rods, which can be employed by itself or in cooperation with other assemblies, such as shearing and/or straightening assemblies, and comprises a central body (14) of a substantially cylindrical shape with an upper work platform (40) on which are positioned a mechanism (12) for linear feed of a rod (21) together with two outlets and clamping mechanisms (13), and comprises also a satellite (15) of a substantially annular shape with a bending unit (11) comprising a bending roller (29) able to rotate about an abutment roller (30), the bending unit (11) and the outlets of the feeder mechanism (12) being able to cooperate with each other and to be positioned reciprocally by rotation of the satellite (15) about the central body (14).

10 Claims, 3 Drawing Sheets

BENDING ASSEMBLY WITH SATELLITE

BACKGROUND OF THE INVENTION

This invention concerns a bending assembly with satellite which can be positioned upstream or downstream of a shears and serves to bend rods according to a desired geometric configuration, which may provide for bends with a clockwise and anticlockwise (right-hand and lefthand) development.

The invention is applied properly to machines that bend sections; the invention is properly employed advantageously, but not only, in machines to bend and shape rods for building work.

This invention is also employed in all cases where rods are to be bent by a bending pin (or equivalent thereof) able to rotate about an axis by a desired angular value clockwise or anticlockwise.

The rods which can be processed by this invention may be rolled, drawn, extruded or formed and be cold or hot processed and have a hollow or solid cross section.

The cross section of the bars which can be processed with this invention is the usual round, oval, square, hexagonal, rectangular, etc. cross section.

If we take a round rod as being the reference element, then the machine according to this invention is prepared and able to process diameters of 50 cms. and more.

The rods to be processed according to this invention are of a straight type, that is to say, straightened and sheared to size, but the machine may include means performing straightening and shearing to size upstream of the invention.

The tasks which a bending machine employing this invention is able to carry out are performed at the present time by two independent bending assemblies distanced from each other and possibly capable of being reciprocally positioned even while at work; each of these two assemblies produces the required bends at its own end of the rod.

Machines of this type are disclosed in FR 2.218.147, DE 3.301.061, U.S. Pat. No. 3,245,433, DE 2,918,813, EP 0141745, EP 0263607, GB 2,169,829, GB 2,181,680, DE 3.236.663 and U.S. Pat. No. 1,488,850.

The known embodiments entail a plurality of shortcomings. A first shortcoming arises from the fact that the two bending assemblies are positioned apart at the normal distance for the most distant bends and can move in relation to each other to make all the other bends required in one single shape. This results in a first shortcoming due to the slowness of the movements and the consequent long time required for the cycle.

A second shortcoming lies in the fact that owing to the great weight of the bending machines the runways undergo great stresses, and the shortcomings are lessened only when the ground surface on which the machines are installed is solid and well levelled.

If, however, the ground surface, for instance of a building site, is not well levelled or the ground is normal, then the movement problems are considerable and after a short time the system for moving the two bending assemblies becomes practically unworkable and labour is continually required for maintenance, repair and corrective work.

Moreover, the system now known requires great installed power, the doubling of all the control circuits, a great waste of materials for construction and trueing and also considerable space tied solely to the employment of the compound machine thus embodied.

SUMMARY OF THE INVENTION

So as to obviate all these shortcomings and to embody a bending machine which is very compact and versatile, swift to use and practical to operate and does not entail useless downtimes, the present applicant has designed, tested and embodied an entraining assembly with a double bending assembly according to this invention.

According to the invention the bending assembly with satellite comprises a central body which bears means to clamp a rod or rods and means to feed the rod or rods axially.

Hereinafter we shall refer to one rod alone but shall mean that one or more rods can be processed at one and the same time.

Means to clamp the rod can be located upstream or downstream of the means to feed the rod axially. These clamping means may be self-aligning or may include a stationary vice or vice which can be fixed as required to achieve the desired parallelism with the axial feeder means.

The axial feeder means may consist of a plurality of pairs of entraining rollers or a pair of opposed entraining tracks or else a mixed assembly of entraining rollers and tracks.

The means that feed the rod axially may be self-aligning or may comprise means on one side which can move in relation to the means on the other side. These axial feeder means are able to move in both directions so as to draw the rod forwards or backwards.

A satellite is included about the circumference of the central body and is able, in cooperation with the central body, to take up at least two distinct positions at about 180° to each other in relation to the means that feed the rod axially.

Bending means are located on the satellite and can take up a first working position in cooperation with one outlet of the axial feeder means and a second working position in cooperation with the other outlet of the axial feeder means; the two outlets are placed at 180° to each other.

In both the two working positions and in the neighbourhood of the two outlets, the bending means can have two positions at a tangent to the rod leaving the outlets.

A first position has an abutment roller on the right of the rod and a bending roller on the left of the rod, which is located between these rollers.

A second position has the abutment roller on the left of the rod and the bending roller on the right of the rod, which is located between these rollers.

According to a first variant a satellite is rotated about the central body and is made to take up the required positions in relation to the axis on which the rod lies.

According to a second variant, which can be used when the rod is relatively short, the central body is rotated to position the rod in relation to the bending unit. In this case the satellite can be stationary or can move by the amount necessary to position the abutment roller on the right or left of the rod.

The central body has a vertical working position and a higher position to disengage the rod from the bending means.

If the satellite bears a bending unit which is stationary or only able to move by a short (circular or straight) distance, it is possible to arrange that the central body is stationary vertically in one single position and that the bending unit can move vertically and can take up one working position and one retracted position.

The vertical movement of the bending unit may be straight or be an overturning movement or an overturning movement about a hinge.

The invention enables the required bends to be carried out to the right or to the left and at one end or the other end of the rod.

BRIEF DESCRIPTION OF THE DRAWINGS

Let us now see with the help of the attached figures, which are given as a non-restrictive example, a possible embodiment of the invention in which the satellite can rotate by more than 180° and the central body can take up at least two vertical positions, as follows.

DETAILED DESCRIPTION OF THE PREFERRED EMBODIMENTS

Figure 1:
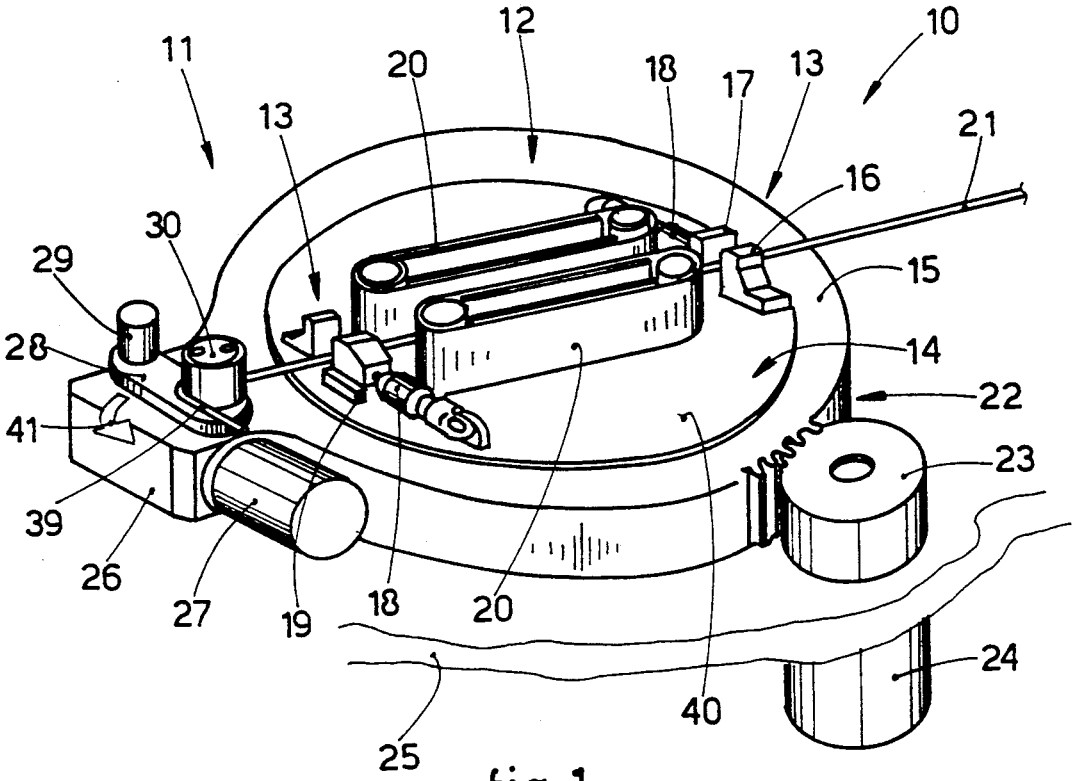
FIG. 1 shows a bending assembly with a lefthand bend just made.

A bending assembly 10 with satellite comprises a bending unit 11 installed on a satellite 15 and a central body 14 that includes feeder means 12 and clamping means 13 on a work platform 40.

In this example the clamping means 13 are two in number and are located at the two ends of the feeder means 12.

The feeder means 12 are actuated by a first motor 35 through a transmission 36 (see FIG. 5) and are opposed tracks 20 in this case.

Their reciprocal positioning to feed a rod 21 is obtained in any known manner and is not important for the purposes of this invention.

The clamping means 13 comprise a stationary jaw 16 and a movable jaw 17 able to slide on guides 19 (see FIG. 5) and actuated, for instance, by a first jack 18. The stationary jaw 16 can be positioned for its alignment as required.

Figure 5:
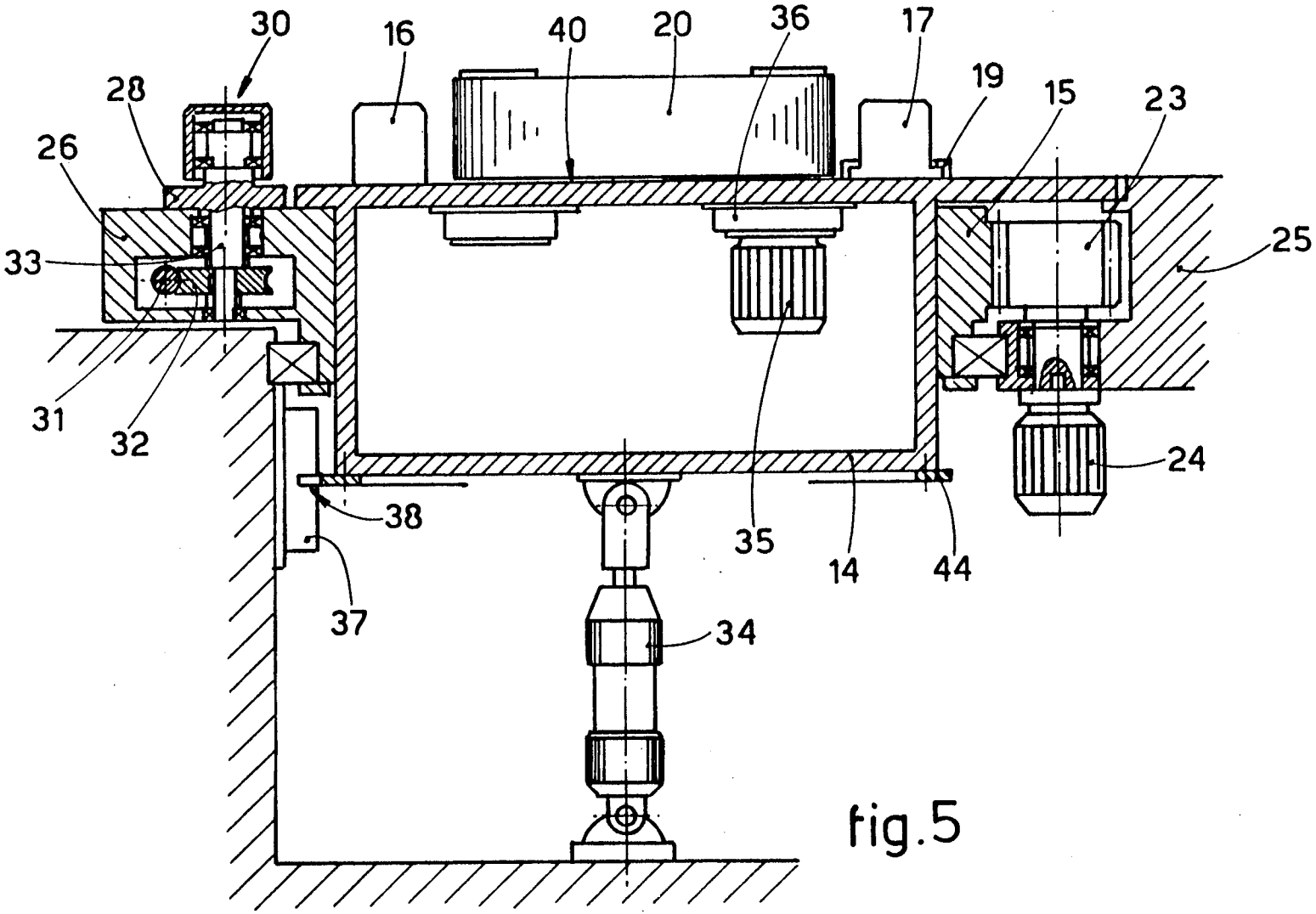
FIG. 5 shows a possible vertical section of the bending assembly of the previous figures.

In the example shown in FIG. 5, the central body 14 has a circular section and cooperates with rotation-prevention means 37 and 38 that prevent rotation of the central body 14 but permit vertical movement thereof.

In this case the rotation-prevention means consist of a vertical guide 37 and a slider 38 solidly fixed to the central body 14.

The central body 14 has a working position (FIGS. 1, 3, 4 and 5) and a position to free the rod 21 from the bending unit 11 (FIG. 2); the latter position is such as to free the rod from conditionings not included in the central body 14.

In this example this freed position is obtained by a second jack 34 and by a travel limiting means 44, which determines the maximum ascent travel in such a way that the work platform 40 is definitely higher than the bending unit 11.

The travel limiting means 44 may be of an adjustable type or may include a shock absorber or else may be connected to electronic means that monitor the position and actuation of the elevator second jack 34.

The elevator means 34 may also comprise a rack, screw, etc., the actual type employed being unimportant.

As shown most clearly in FIGS. 1–4, the satellite 15 is positioned about the central body 14 and comprises teeth on its edge 22 along an arc greater than 180°. These teeth cooperate with a gear wheel 23 actuated by a second motor 24.

The bending unit 11 is positioned on the satellite 15 and comprises an idler abutment roller 30, an orientation arm 28 and a bending roller 29. The orientation arm 28 is actuated by a third motor 27.

In the example shown in FIG. 5 the third motor 27 actuates a worm 31, which acts on a gear wheel 32 connected by a shaft 33 to the orientation arm 28.

In this example the satellite 15 comprises a projection 26 on which the bending unit 11 is positioned.

Known means to monitor and control the position of the rod 21 are included in cooperation with the feeder means 12, so that the functioning of the assembly can take place automatically.

Positioning is simple. When the rod 21 has been placed between the feeder means 12 and clamping means 13, it is gripped by the feeder means 12 and fed forwards at a tangent to the idler abutment roller 30.

As a bend 39 has to be made and the orientation arms 28 has to rotate according to the arrow 41, the bending roller 29 will be positioned on the right of the rod 21 (FIG. 1).

When the rod 21 reaches its required position, the clamping means 13 are actuated and the bending unit 11 is rotated according to the arrow 41 so that the bend 39 is made.

Figure 2:
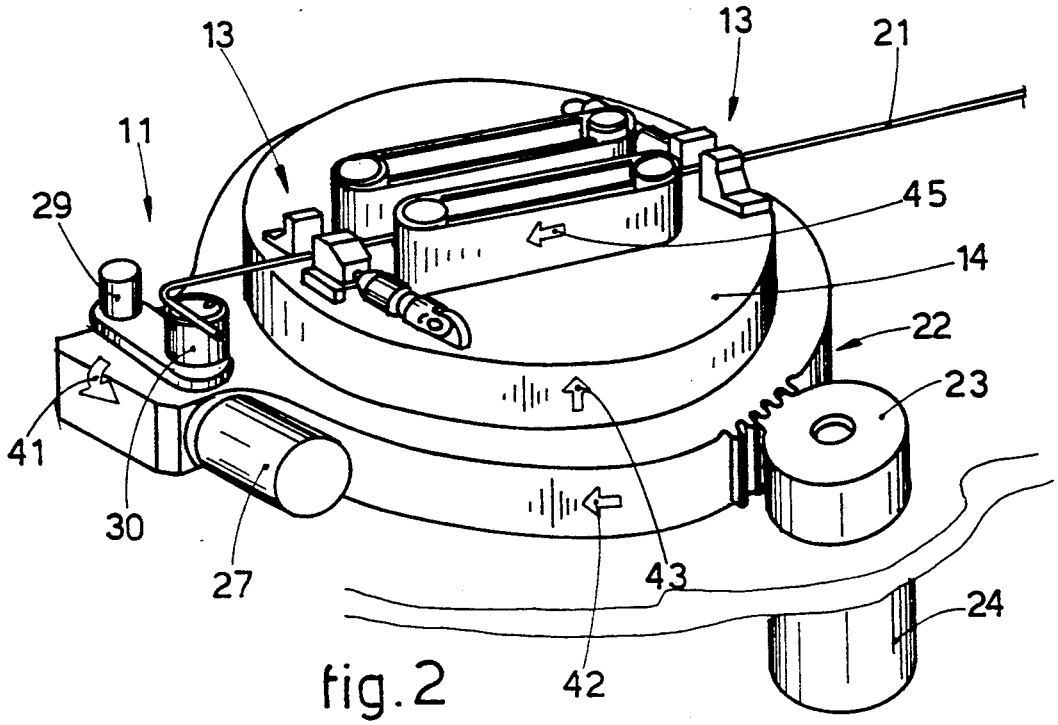
FIG. 2 shows the bending assembly with the central body lifted to free the rod.

If the next bend is to be inverted, the central body 14 is lifted by a required value according to the arrow 43 (FIG. 2).

When the central body 14 is in its raised position, the satellite 15 is rotated according to the arrow 42 so that the abutment roller 30 is brought to the right of the rod 21, while the orientation arm 28 is rotated according to the arrow 41 so as to bring the bending roller 29 to the left of the rod 21.

In the meanwhile the rod 21 can be fed forward by the required value and then lowered in the opposite direction to the arrow 43.

Figure 3:
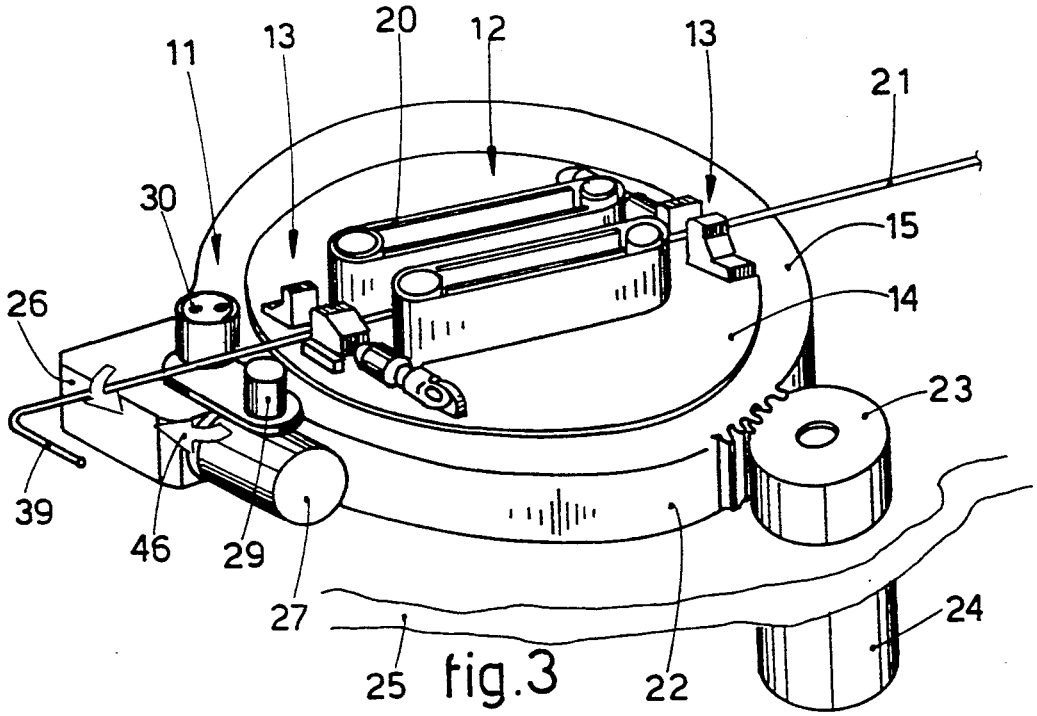
FIG. 3 shows the bending assembly with a bending unit ready to make a righthand bend.

In this way the rod 21 is placed at a tangent to the idler abutment roller 30 but to the left thereof 30 (FIG. 3).

The satellite 15 is rotated by means of the gear wheel 23.

The next bend is then made by rotation of the orientation arm 28 according to the arrow 46 (FIG. 3). This bend is a righthand bend, whereas the previous bend was a lefthand bend.

When the desired bends have been applied to one end of the rod 21, the central body 14 is lifted according to the arrow 43 and the satellite 15 is rotated about 180°, so that the idler abutment roller 30 is placed to the right or left of the rod 21, and the rod 21 is fed forward until its other end is positioned for bending.

Figure 4:
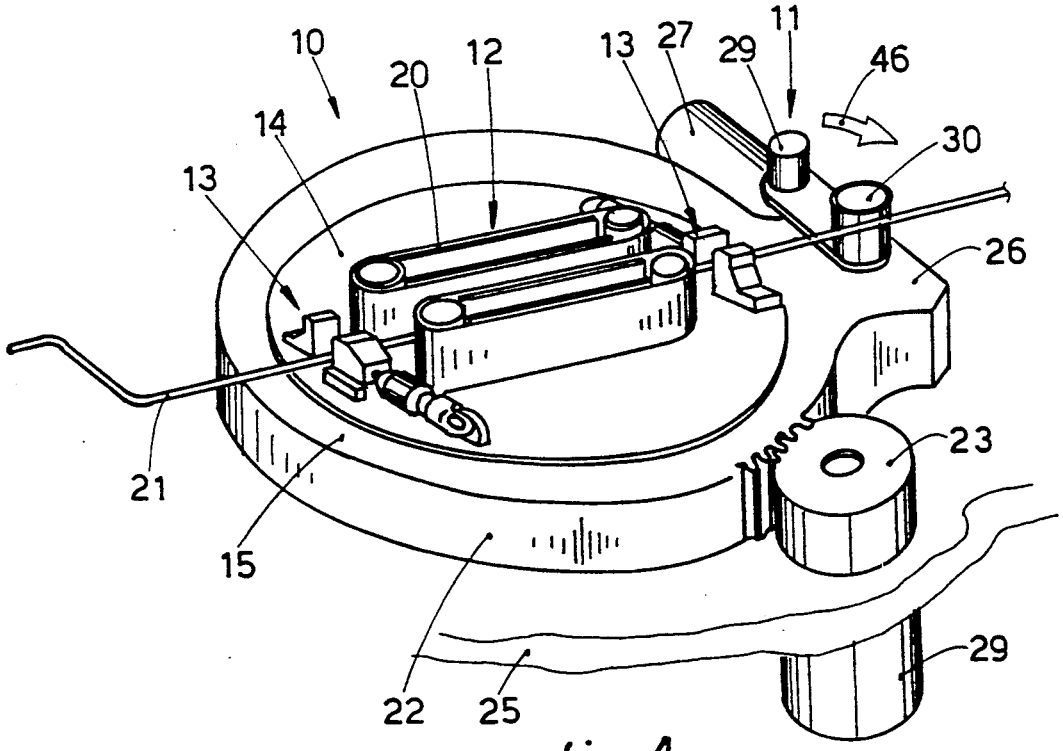
FIG. 4 shows the bending assembly ready to bend the other end of the rod.

The central body 14 is then lowered so that the other end of the rod 21 is positioned correctly in relation to the bending unit 11 (FIG. 4).

Forward or backward movement of the rod 21 actuated by the feeder means 12 can take place with the central body 14 in its raised position or its lowered position.

The invention is therefore disclosed with a linear feeder means 12 cooperating with a bending unit 11, which can cooperate with one or the other inlet of the linear feeder means 12.

I claim:

1. A bending assembly for bending rods, comprising:

a central body having a substantially cylindrical shape and an upper work platform on which are positioned feed means for linear feed of a rod and clamping means for clamping said rod, said feed means having opposed first and second outlets;

a satellite comprising a body having a substantially annular shape and being provided about the circumference of said central body; said satellite being provided with a bending unit comprising an abutment roller and a bending roller able to rotate about said abutment roller to impart a bend to a rod leaving one of said first and second outlets;

means for rotating one of said central body and said satellite so as to change the relative position of said central body and said bending unit and to enable said bending unit to be positioned adjacent either one of said first and second outlets.

2. A bending assembly as claimed in claim 1, wherein said means for rotating rotates said satellite around at least 180° of the circumference of said central body.

3. A bending assembly as claimed in claim 1, wherein said means for rotating rotates said central body at least 180° with respect to said satellite.

4. Bending assembly as claimed in claim 1, in which an abutment roller cooperates with each of the outlets of the feeder means in positioning itself on the right or left of the rod.

5. Bending assembly as claimed in claim 1, in which the satellite can rotate about the central body by at least 180°.

6. Bending assembly as claimed in claim 1, in which the satellite is displaced laterally at least to position the abutment roller of the bending assembly on the right or left of the rod.

7. Bending assembly as claimed in claim 1, in which the central body can rotate on its own axis by at least 180°.

8. Bending assembly as claimed in claim 4, in which the central body can rotate on its own axis at least by an angle that comprises the diameter of the abutment roller of the bending unit.

9. Bending assembly as claimed in claim 1, in which the central body has a working position and a vertically higher disengaged position.

10. Bending assembly as claimed in claim 1, in which the bending unit has a working position and a retracted position below the level of the upper work platform.

* * * * *